US006053216A

United States Patent [19]

Debaes et al.

[11] Patent Number: 6,053,216

[45] Date of Patent: Apr. 25, 2000

[54] WEAVING MACHINE PILE WARP THREAD TENSIONING AND DRAWING-BACK DEVICE

[75] Inventors: Johnny Debaes, Moorslede; Nico Seynaeve, Wevelgem, both of Belgium

[73] Assignee: N.V. Michel Van de Wiele, Kortrijk/Marke, Belgium

[21] Appl. No.: 09/056,874

[22] Filed: Apr. 8, 1998

[30] Foreign Application Priority Data

Apr. 17, 1997 [BE] Belgium ..... 09700352

[51] Int. Cl.[7] ..... D02H 13/24; B65H 59/36

[52] U.S. Cl. ..... 139/103; 28/194; 112/254; 139/453; 242/150 R

[58] Field of Search ..... 242/150 R, 150 M; 66/146; 139/37, 109, 103, 453, 25, 26; 28/194; 112/254

[56] References Cited

U.S. PATENT DOCUMENTS

| | | | |
|---|---|---|---|
| 2,246,989 | 6/1941 | Sparkes | 242/150 R |
| 3,181,569 | 5/1965 | Carroll | 242/150 R |
| 3,356,050 | 12/1967 | Urscheler | 242/150 R |
| 3,967,657 | 7/1976 | Cugini | 242/150 R |

FOREIGN PATENT DOCUMENTS

| | | |
|---|---|---|
| 0742297 | 11/1996 | European Pat. Off. . |
| 1010315 | 2/1950 | France . |
| 1315921 | 12/1961 | France . |
| 0617215 | 8/1933 | Germany . |

*Primary Examiner*—Andy Falik

*Attorney, Agent, or Firm*—James Creighton Wray; Meera P. Narasimhan

[57] ABSTRACT

A thread tensioning and drawing-back device for pile warp threads of a weaving machine, which device comprises provisions (2) for braking, by spring elements, pile warp threads (4) taken up by a weaving machine, and provisions (5) for drawing back the pile warp threads (4) in case of variations of warp length resulting from changing the shed position of the weaving machine, in which the provisions (2) for braking the pile warp threads (4) consist of disk springs (2) placed next to each other in a row on a horizontal spindle (3), each provided for braking one pile warp thread (4). The device can furthermore comprise preferably detachable tension spindles (11), (12) at the entrance to the disk yarn brakes (2) and at the exit from the disk yarn brakes (2). Provisions (5) for drawing back the pile warp threads (4) can comprise devices such as namely weight levers (5) or flat springs (25) which each separately hold taut the thread for a separate disk yarn brake (2), and which collectively, per row of disk yarn brakes (2), are mounted on a common shaft (14), (24).

10 Claims, 7 Drawing Sheets

WEAVING MACHINE PILE WARP THREAD TENSIONING AND DRAWING-BACK DEVICE

BACKGROUND OF THE INVENTION

The invention relates to a device with which the feeding of pile warp threads to a weaving machine is regulated. More specifically the device ensures that the threads which are drawn off distribution bobbins out of the weaving machine are slowed down in suitable manner in order to ensure a uniform take-up, and that the threads, in case of variations of warp length resulting from changes in the shed position of the weaving machine, such as in particular with Jacquard weaving, are drawn back in order to keep the threads suitably taut.

The principle of such thread tensioning and drawing-back devices is in itself known in the state-of-the-art.

Hence the Belgian patent application 9500426 describes a thread tensioning and drawing-back device with a pile warp yarn brake consisting of a folded-over leaf spring which presses against a stop surface and between which the pile warp yarns are pulled. The braking device described in this patent also has certain disadvantages: This type of braking is subject to becoming fouled through breaking-off filaments. Because of their width these have to be placed in two layers one above the other. Each leaf spring has to be individually adjusted which for a large number of warp threads is a time-consuming work.

In the Belgian patent application 9600219 a thread tensioning and drawing-back device is described whereby the pile warp yarn brake consists of disk springs which are placed horizontally on a vertical spindle. The pressure on the disks is adjusted with a nut which tightens a conical pressure spring. This brake has the disadvantage that the yarn must be passed through a slot hole in the spindle, which is time-consuming for a first threading. This slot hole serves for holding the yarn between both disks. These disk springs have a certain diameter and they therefore need to be spread over two layers in a number of rows in order to respect a certain number of pile warp yarns in the depth of the frame. This solution therefore takes up a lot of room. Furthermore each spring has to be individually adjusted which of course is very time-consuming with a large number of pile warp yarns. Blockages easily occur in the slot hole through fouling by breaking-off filaments, through which the brake will work less efficiently.

The object of this invention is to offer a solution to the disadvantages linked to the known thread tensioning and drawing-back devices.

For this purpose,the invention provides a thread tensioning and drawing-back device for pile warp threads of a weaving machine, which device comprises provisions for braking, by means of spring elements, pile warp threads taken up by a weaving machine, and provisions for drawing back the pile warp threads in case of variations of warp length resulting from changing the shed position of the weaving machine, in which the provisions for braking the pile warp threads consist of disk springs placed next to each other, in a row on a horizontal spindle, each provided for braking one pile warp thread.

According to an additional aspect of the invention in the thus defined thread tensioning and drawing-back device the provisions for drawing back the pile warp threads can preferably also comprise means which each separately hold taut the thread for a separate disk yarn brake, and which collectively, per row of disk yarn brakes, are mounted on a common shaft.

According to another embodiment of the thread tensioning and drawing-back device according to the invention the disk springs are preferably provided rotating freely on the horizontal spindle.

Furthermore according to another aspect of the invention means can be provided in order through one single pressure spring to tighten collectively the disk springs placed on one spindle.

The aforesaid means for tightening the disk springs can for example comprise an adjusting ring which is movable in axial direction on the spindle extremity, or a nut which is rotatable on a screw thread provided on the spindle extremity.

Thus with one adjustment a whole row of pile yarns can be brought to equal tension.

According to yet a further embodiment of the invention the thread tensioning and drawing-back device can very suitably be provided with tension spindles, more especially two tension spindles per row of disk yarn brakes, one at the entrance to the disk yarn brakes and one at the exit from the disk yarn brakes. These spindles ensure that the yarn remains between the disks and rubs against the central spindle, whereby the disks can preferably rotate around the central spindle and the yarn runs under the spindle, so that fouling through breaking-off filaments is counteracted. Both tension spindles are preferably detachable which greatly facilitates a first threading. The pile warp yarns can indeed be brought between the disks with a reed and only then the turn guiding spindles put in place. In case of wearing away of the spindles through the rubbing warp threads the spindles can easily be replaced. The guiding spindles are held in their seats by a wire clip.

The thread tensioning and drawing-back device according to the invention is preferably made as a separate module to be placed in front of the weaving frame, so that each bobbin in the frame no longer requires any weights for tension regulation.

For the thread tensioning and drawing-back device according to the above described more specific aspect of the invention, in which the provisions for drawing back the pile warp threads comprise means which each separately hold taut the thread for a separate disk yarn brake, and which collectively, per row of disk yarn brakes, are mounted on a common shaft, the invention provides two particularly preferred embodiments, namely one in which the aforesaid means consist of rotatable weight levers, and one in which the aforesaid means consist of flat springs which collectively, with the shaft on which they are mounted, can be pre-tensioned.

In the embodiment in which the threads are held under tension by means of rotatable weight levers those weight levers preferably consist of a series of flat bars which at one extremity are rotatably suspended from a common shaft and which at the other extremity are provided with in themselves known individual guiding means for a thread. The weight levers can moreover very suitably at the one extremity where they are suspended simply be provided with a hole with which the lever can be slid loosely rotatable onto the suspension shaft.

In the embodiment in which the threads are held under tension by means of springs those springs preferably consist of small flat springs or strips which are disposed next to each other and are collectively secured by one extremity between clamping rods which themselves are connected to a rotatable adjusting shaft. At the other extremity the spring strips are provided with in themselves known individual guiding means for a thread. By rotating the adjusting shaft the spring strips can collectively be tightened as desired.

According to yet a further aspect of the invention the thread tensioning and drawing-back device preferably also comprises electrodes for detecting yarn breakage and/or yarn overtension, by detecting the contact of such an electrode with one of the means for keeping the threads taut.

For that purpose the shaft on which the provisions for drawing back the pile warp threads (such as the above described weight levers or flat springs) are collectively mounted is connected to an electric voltage supply, and above and/or below the row of drawing-back provisions a detection rod is mounted which is connected via an electric current detector to the other pole of the electric voltage supply. In case of breakage of a thread the corresponding drawing-back provision falls or jumps back into a position whereby contact is made with the detection rods provided for that purpose and this contact is detected via the current detector. Analogously in case of an overtension on a thread the corresponding drawing-back provision is pulled against the detection rod provided for that purpose and is detected via the current detector.

The operation of the thread tensioning and drawing-back device according to the invention comprises the following aspects: The spring pressure on the disk yarn brake is so adjusted that the warp yarns are pulled from the bobbin when the recovery spring or recovery lever has reached a specific high position. The variations in warp length which occur when changing position of the shed are offset by the recovery device. If the recovery spring becomes completely slack or the lever falls down fully then this indicates a warp yarn breakage. If the recovery spring or the recovery lever is brought completely into a horizontal line with the guiding spindle and exiting grid then this indicates an overtension. Both of these positions are detected by a contact with an electrode.

The characteristics and distinctive features of the invention, and its operation are explained in greater detail hereafter with reference to the attached drawings which represent two preferred embodiments of the invention.

DETAILED DESCRIPTION OF THE PREFERRED EMBODIMENT

In these figures the same reference numbers refer to the same or similar parts.

Figure 1:
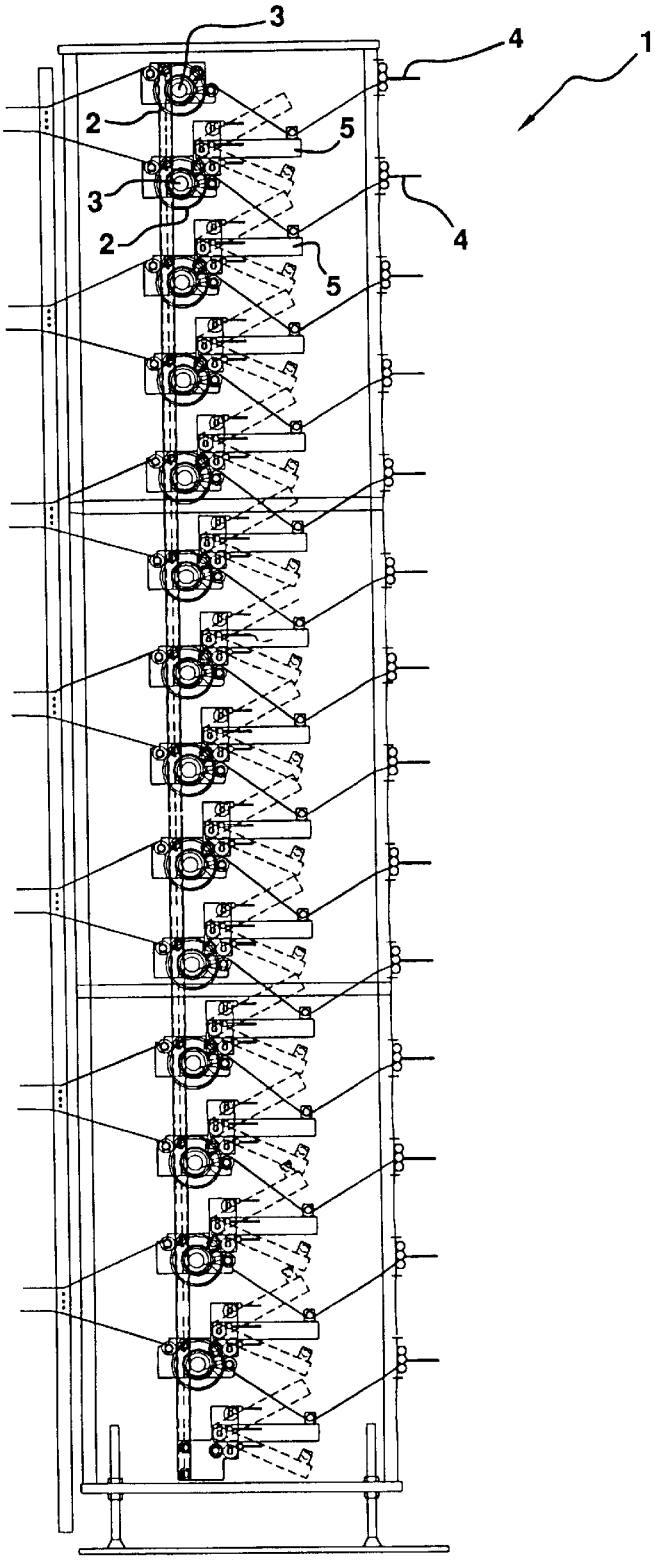
FIG. 1 is a side view of a thread tensioning and drawing-back device according to the invention made as a separate module.

The thread tensioning and drawing-back device (1) according to the invention, made as a separate module, shown in FIG. 1 comprises several rows of disk springs (2) which are collectively mounted per row on a common shaft or spindle (3). Pile warp threads (4) coming from a weaving frame (not shown) run via the disk springs (2)—which function as provisions for braking the threads and via weight levers (5)—which function as provisions for drawing back or recovering the threads—to a weaving machine (not shown).

Figure 2:
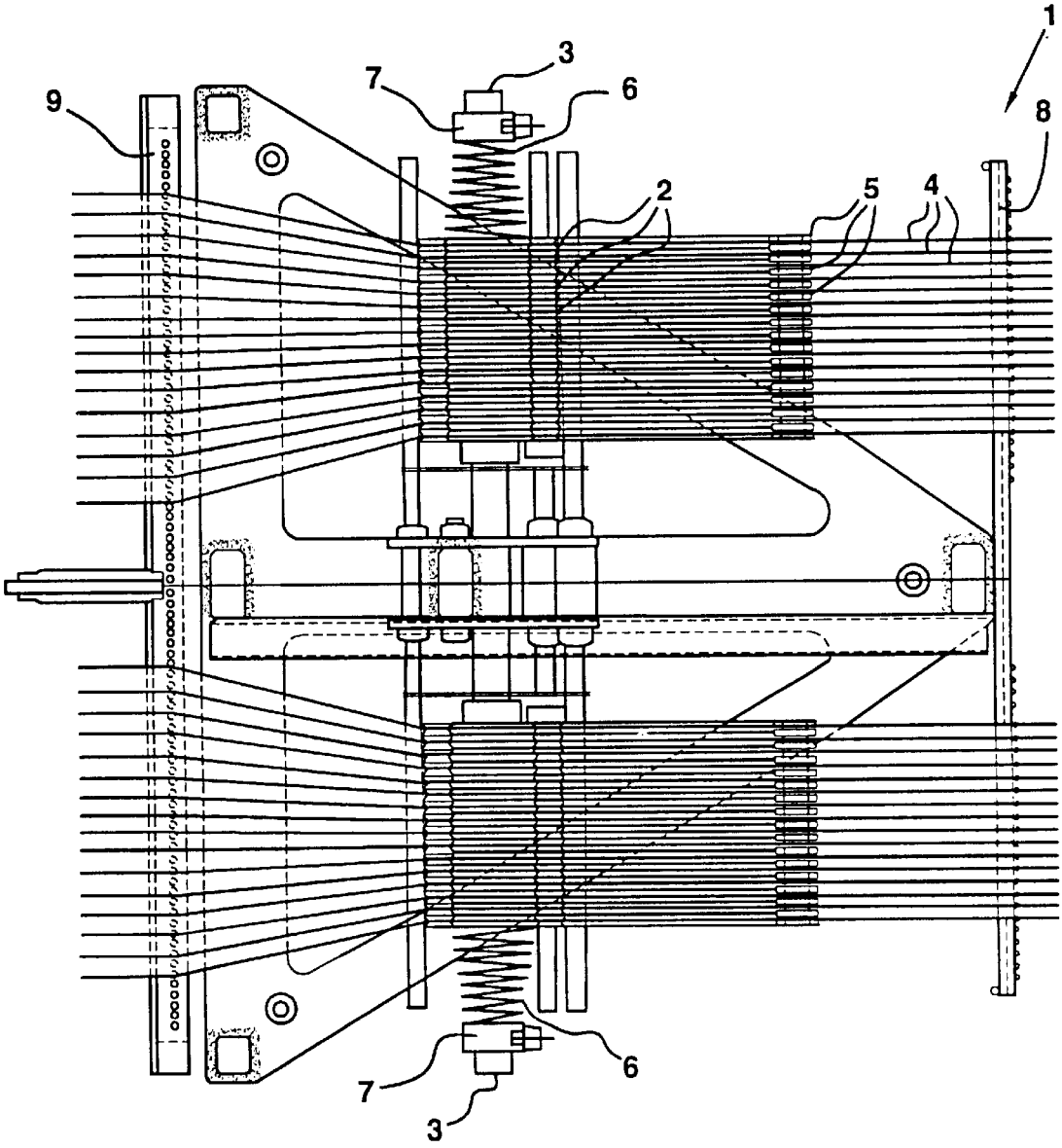
FIG. 2 is a view from above of the module according to FIG. 1.
Figure 3:
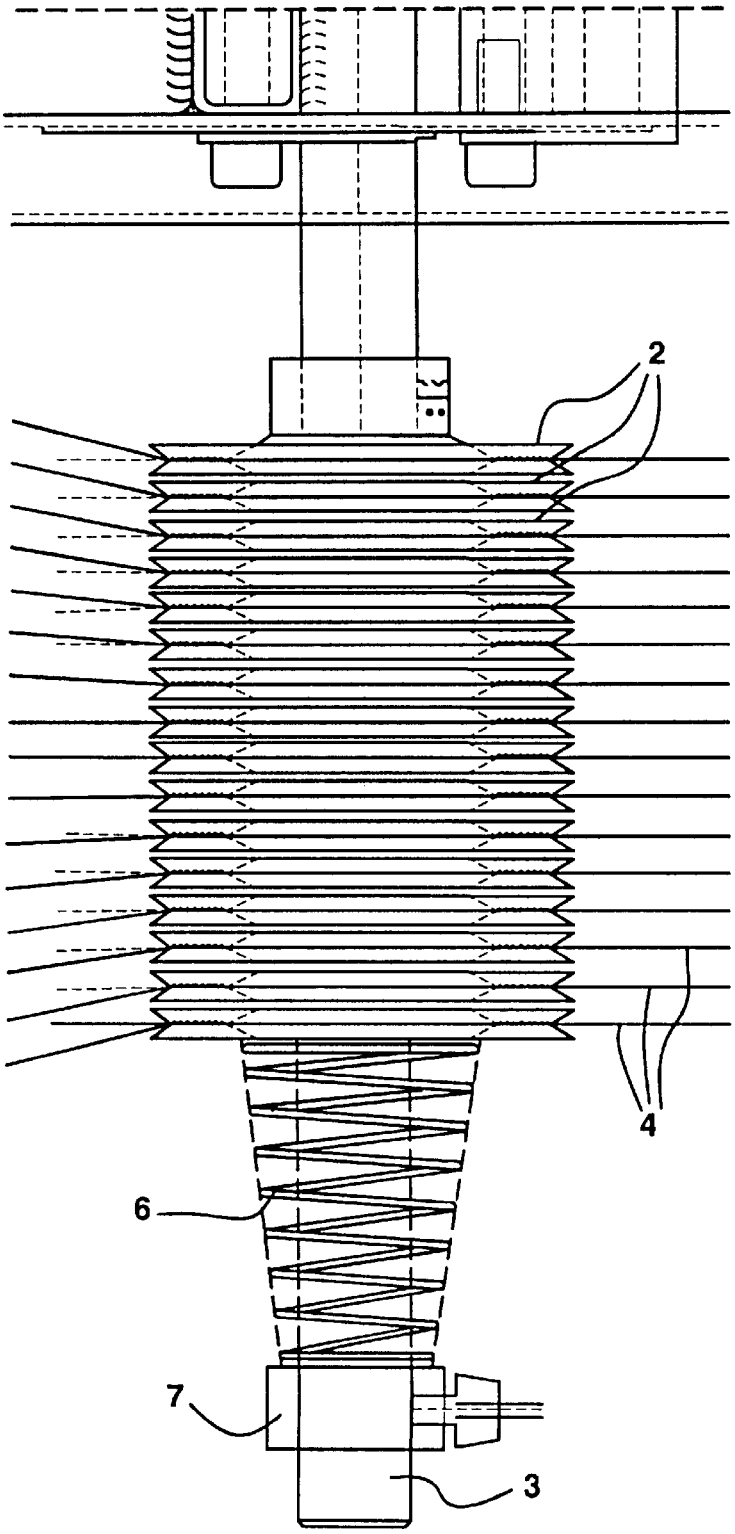
FIG. 3 is a detailed view from above of a row of disk yarn brakes for a thread tensioning and drawing-back device according to the invention.

FIG. 2 shows a view from above of the same module (1) with disk springs (2), disk spring spindle (3), pile warp threads (4) and weight levers (5). FIG. 2 further shows pressure springs (6) which are used for collectively tightening one row of disk springs by means of an adjusting ring (7). In FIG. 2 the guiding reeds or grids (9) out of the weaving frame and the guiding reeds or grids (8) into the weaving machine are furthermore also shown. A detailed view of one set of disk springs (2), with spindle (3), the threads (4), the pressure spring (6) and the adjusting ring (7) is shown in FIG. 3.

Figure 4:
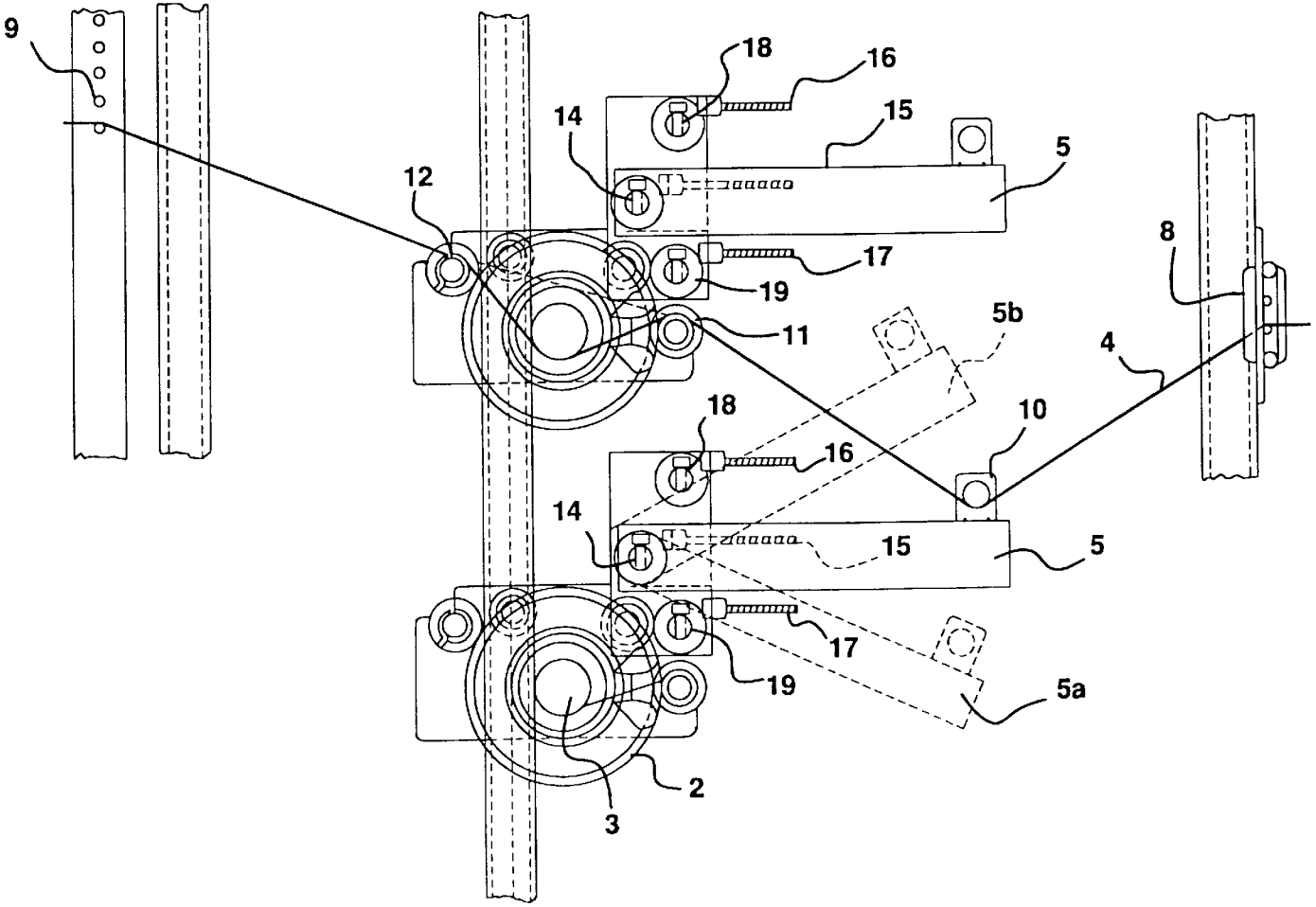
FIG. 4 is a detailed side view of two provisions for braking and for drawing back the pile warp threads of the module according to FIGS. 1 and 2.
Figure 5:
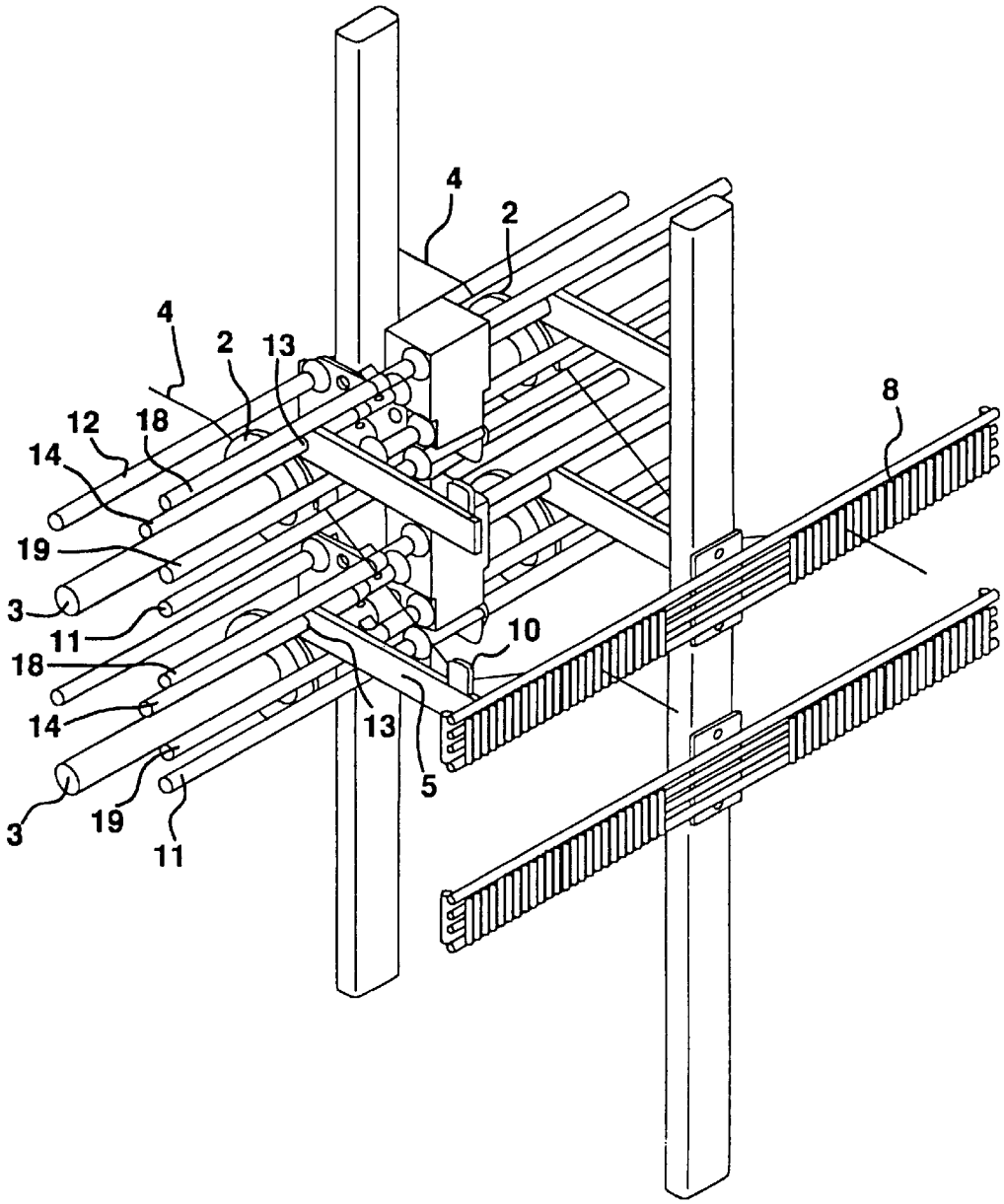
FIG. 5 is a view in perspective of the part of the module shown in FIG. 4 of the module according to FIGS. 1 and 2.

In FIGS. 4 and 5 the operation of the thread tensioning and drawing-back device (1) according to the invention, and the levers (5) functioning as recovery device are illustrated in greater detail. In FIG. 5 moreover for easy reference in each case only one disk spring (2), one thread (4) and one recovery lever (5) per set or group of disk springs is represented. In these FIGS. 4 and 5 it can namely be seen how the pile warp thread (4) is held taut via guiding means (10) which are provided on the free extremity of the recovery lever (5). Each recovery lever (5) of one set or group is freely rotatably suspended from a common shaft (14) via a hole (13) provided on the other extremity of the recovery lever.

Tension or turn guiding spindles (11) and (12) which are disposed before—(11)—and after—(12)—the disk springs (2) for guiding the thread can moreover be seen in these figures.

Finally FIGS. 4 and 5 also show provisions for yarn breakage and yarn overtension detection, consisting of connections (15) from each suspension shaft (14) for the recovery levers (5) to a voltage supply (not shown), and of connections (16) and (17) from detection electrodes (18), (19), in the form of respective shafts (18) for detecting yarn overtension and shafts (19) for detecting yarn breakage, to the other pole of the aforesaid voltage supply; the detection of yarn breakage or yarn overtension occurs for example by means of (a) current detector(s) provided in the electric circuit(s) which the connections (15) and (16) and/or (17), and the current supply comprise(s).

In FIG. 4 the positions of the weight lever (5) are indicated for yarn breakage and for yarn overtension respectively as **(5*a*) and (5*b*). In case of yarn breakage via the contact between the recovery lever in position (5*a*) and detection shaft (19) the electric circuit is closed that effects the detection of that yarn breakage. In case of yarn overtension via the contact between the recovery lever in position (5*b*) and detection shaft (18)** the electric circuit is closed that effects the detection of that yarn overtension.

Figure 6:
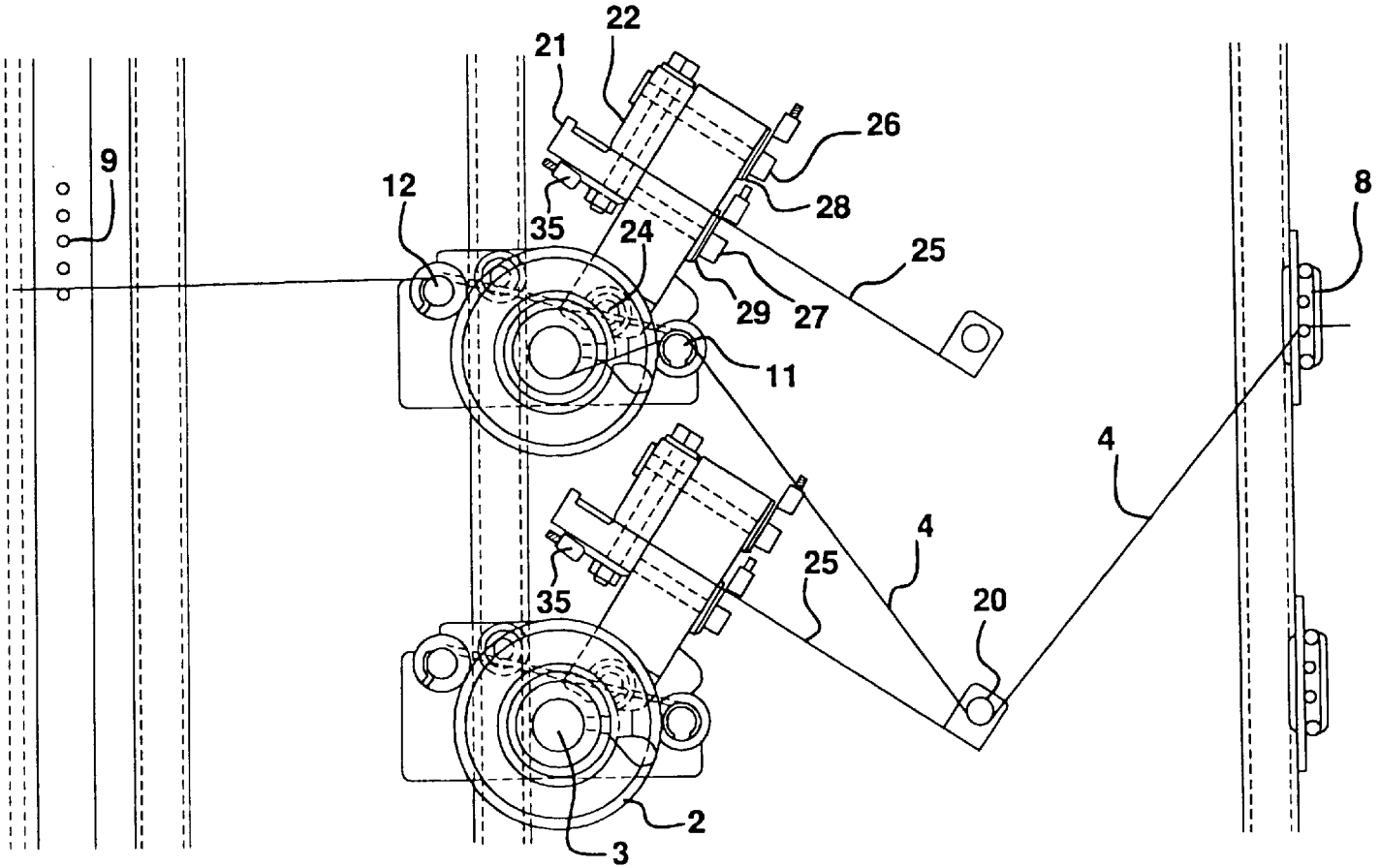
FIG. 6 is a detailed side view of two provisions for braking and for drawing back the pile warp threads of a thread tensioning and drawing-back device according to the invention, in a variant embodiment, in relation to FIG. 4, of the drawing-back provisions.
Figure 7:
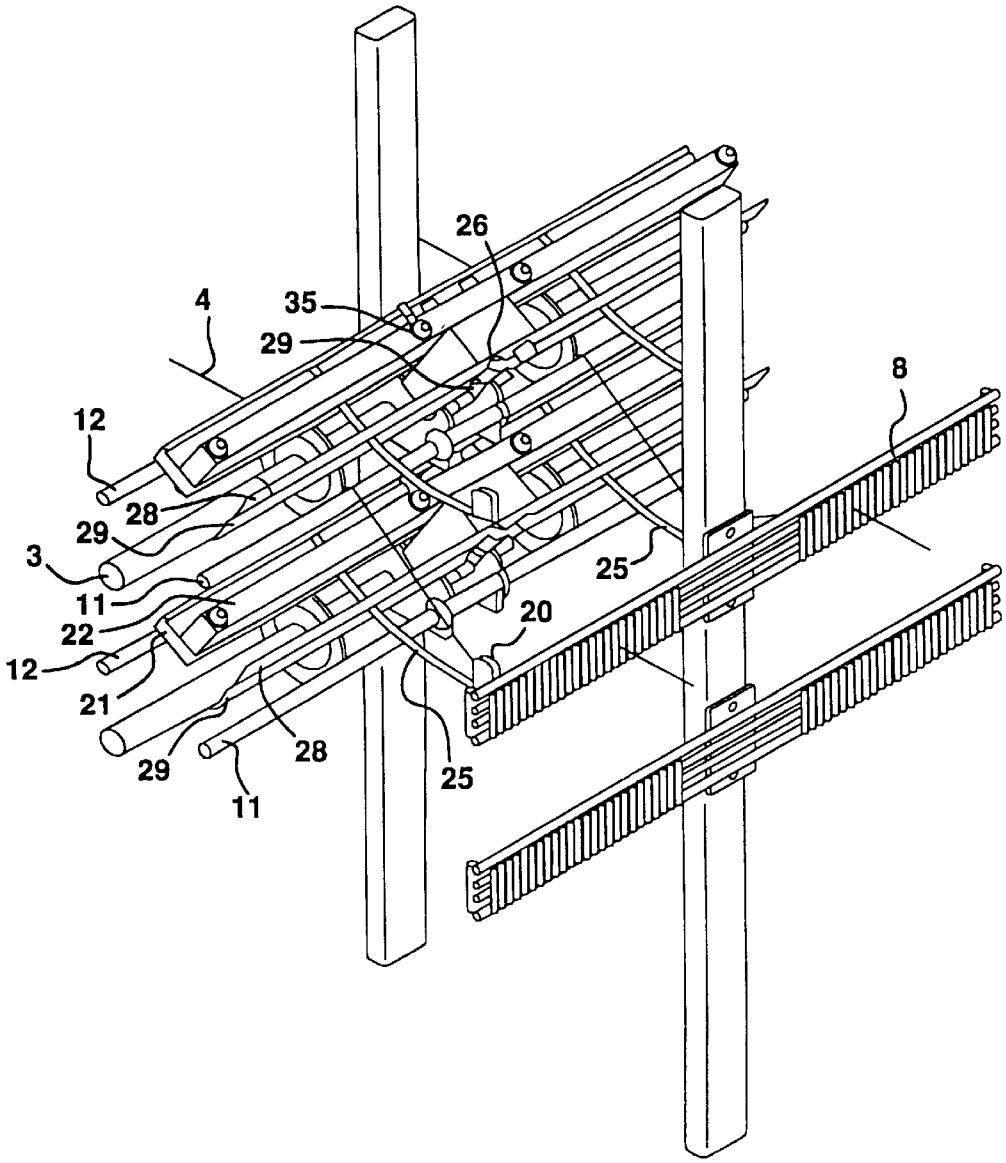
FIG. 7 is a view in perspective of the part shown in FIG. 6 of a thread tensioning and drawing-back device according to the invention.

In FIGS. 6 and 7 analogously to that in FIGS. 4 and 5 the operation of another variant of the thread tensioning and drawing-back device (1) according to the invention is illustrated in greater detail. The variant according to FIGS. 6 and 7 comprises spring strips (25) functioning as recovery device which are provided with thread guiding means (20). The strips (25) are mounted per row between two common clamping rods (21), (22); a common supporting structure for the clamping rods (21), (22) is rotatably suspended from a common shaft (24) so that all strips (25) can be collectively pre-tensioned per row through rotation of the supporting structure around the shaft (24).

The provisions for yarn breakage and yarn overtension detection, consist of connections (35) from each clamping rod (21) for the recovery strips (25) to a voltage supply (not shown), and of connections (26) and (27) from detection electrodes (28), (29), in the form of respective flat rods (28) for detecting yarn overtension and flat rods (29) for detecting yarn breakage, to the other pole of the aforesaid voltage supply; the detection of yarn breakage or yarn overtension occurs for example by means of (a) current detector(s) provided in the electric circuit(s) which the connections (35) and (26) and/or (27), and the current supply comprise(s).

In FIG. 6 the position of a recovery strip (25) is represented for yarn breakage. The contact between the recovery strip (25) and detection rod (29) closes the electric circuit that effects the detection of that yarn breakage.

In case of yarn overtension via the contact between the recovery strip (25) and detection rod (28) the electric circuit is closed that effects the detection of that yarn overtension.

It is to be noted that the specific aspects of the embodiments of the invention described above in greater detail are only intended as preferred examples within the scope of the general description of the invention given for that purpose, and must in no way be interpreted as a limitation of the scope of the invention as such or as expressed in the following claims.

What is claimed is:

1. A weaving machine with thread tensioning and drawing-back device for pile warp threads of the weaving machine comprising means for braking pile warp threads of the weaving machine, and means for drawing back the pile warp threads in case of variations of warp length resulting from changing a shed position of the weaving machine, a horizontal spindle on the weaving machine, wherein the means for braking the pile warp threads consist of disk springs positioned adjacent each other in a row on the horizontal spindle, and wherein each means is provided for braking one pile warp thread, wherein the means for drawing back the pile warp threads comprise plural means each separately holding taut a thread for a separate disk yarn brake, wherein the plural means are collectively mounted on a common shaft per row of disk yarn brakes, and wherein the plural means are rotatable weight levers.

2. The weaving machine and device of claim 1, wherein the disk springs comprise mounting means for mounting on the horizontal spindle such that the disk springs are freely rotatable on the horizontal spindle.

3. The weaving machine and device of claim 1, further comprising tightening means provided sequentially via a pressure spring for tightening collectively the disk springs on the spindle.

4. The weaving machine and device of claim 3, wherein the tightening means comprises an adjusting ring movable in an axial direction on the spindle extremity.

5. The weaving machine and device of claim 3, wherein the tightening means comprises a nut rotatable on a screw thread provided on a spindle extremity.

6. The weaving machine and device of claim 1, further comprising a disk yarn brake on the weaving machine and tension spindles, and wherein the tension spindles are between an entrance and an exit of the disk yarn brakes.

7. The device of claim 1, wherein the tension spindles comprise connection means for detachably connecting to the weaving machine.

8. The weaving machine and device of claim 1, further comprising a module adapted to be separably connected to a weaving frame.

9. A weaving machine with thread tensioning and drawing-back device for pile warp threads of the weaving machine comprising means for braking pile warp threads of the weaving machine, and means for drawing back the pile warp threads in case of variations of warp length resulting from changing a shed position of the weaving machine, a horizontal spindle on the weaving machine, wherein the means for braking the pile warp threads consist of disk springs positioned adjacent each other in a row on the horizontal spindle, and wherein each means is provided for braking one pile warp thread, wherein the means for drawing back the pile warp threads comprise plural means each separately holding taut a thread for a separate disk yarn brake, wherein the plural means are collectively mounted on a common shaft per row of disk yarn brakes, and wherein the plural means consist of flat springs collectively pretensioned with a shaft on which they are mounted.

10. A weaving machine with thread tensioning and drawing-back device for pile warp threads of the weaving machine comprising means for braking pile warp threads of the weaving machine, and means for drawing back the pile warp threads in case of variations of warp length resulting from changing a shed position of the weaving machine, a horizontal spindle on the weaving machine, wherein the means for braking the pile warp threads consist of disk springs positioned adjacent each other in a row on the horizontal spindle, and wherein each means is provided for braking one pile warp thread, wherein the means for drawing back the pile warp threads comprise plural means each separately holding taut a thread for a separate disk yarn brake, wherein the plural means are collectively mounted on a common shaft per row of disk yarn brakes, and further comprising electrodes for detecting yarn breakage and/or yarn overtension via contact of the electrode with one of the plural means for keeping the threads taut.

* * * * *